US005975200A

United States Patent [19]

Kato et al.

[11] Patent Number: 5,975,200

[45] Date of Patent: Nov. 2, 1999

[54] PLATE-FIN TYPE HEAT EXCHANGER

[75] Inventors: Seiichi Kato, Toyoake; Sumio Susa, Anjo; Tetuya Yamamoto, Chita-gun, all of Japan

[73] Assignee: Denso Corporation, Kariya, Japan

[21] Appl. No.: 09/228,320

[22] Filed: Jan. 11, 1999

Related U.S. Application Data

[63] Continuation-in-part of application No. 08/842,024, Apr. 23, 1997, abandoned.

[51] Int. Cl.[6] ..... F28D 7/02

[52] U.S. Cl. ..... 165/151; 165/181

[58] Field of Search ..... 165/151, 181, 165/182

[56] References Cited

U.S. PATENT DOCUMENTS

| | | | |
|---|---|---|---|
| 4,830,102 | 5/1989 | Bakay et al. . | |
| 5,076,353 | 12/1991 | Haussmann . | |
| 5,685,367 | 11/1997 | Jun | 165/181 X |

FOREIGN PATENT DOCUMENTS

| | | |
|---|---|---|
| 0 086 559 A2 | 8/1983 | European Pat. Off. . |
| 0 672 882 A1 | 9/1995 | European Pat. Off. . |
| 58-127092 | 7/1983 | Japan . |
| 0210297 | 11/1984 | Japan . |
| 0162134 | 8/1985 | Japan . |
| 0006592 | 1/1986 | Japan . |
| 0015093 | 1/1988 | Japan . |
| 0063499 | 3/1991 | Japan . |
| 0156296 | 7/1991 | Japan . |
| 1313974 | 4/1973 | United Kingdom . |

*Primary Examiner*—Christopher Atkinson
*Attorney, Agent, or Firm*—Harness, Dickey & Pierce, PLC

[57] ABSTRACT

Clearance holding portions for holding a clearance between the adjacent plate fins are spaced from side edges of louvers by a predetermined distance in a direction perpendicular to a flowing direction of air and disposed at an upstream side of tubes in the flowing direction of the air. In this way, air flowing between the adjacent plate fins flows through the louvers without being disturbed by the clearance holding portions, so that an effect of the louvers for improving the heat exchange performance can be maintained sufficiently.

13 Claims, 9 Drawing Sheets

PLATE-FIN TYPE HEAT EXCHANGER

CROSS-REFERENCE TO RELATED APPLICATION

This application is a CIP application of U.S. application Ser. No. 08/842,024, filed on Apr. 23, 1997 now abandoned.

BACKGROUND OF THE INVENTION

1. Field of the Invention

The present invention relates to a plate-fin type heat exchanger which can be used as, for example, a radiator for cooling a cooling water of an internal combustion engine for a vehicle.

2. Description of Related Art

Conventionally, a plate-fin type heat exchanger described in JP-A-58-127092 has been known, for example. The plate-fin type heat exchanger includes a plurality of plate fins, a plurality of tubes penetrating through the plate fins, and upper and lower tanks disposed respectively at upper and lower two ends of the tubes. The plate fins are equipped with clearance holding portions for holding a clearance between each adjacent pair of plate fins (i.e., fin pinch) to a predetermined distance when the plurality of the plate fins are laminated.

FIGS. 4 through 6 show conventional type plate fins 100 having the tubes 101 penetrating through the plate fins 100, louvers 103 formed on the plate fins 100 and the clearance holding portions 105. As shown in FIG. 4, the tubes 101 are disposed in two parallel lines perpendicular to the flowing direction W of air as heat exchanging fluid, and the louvers 103 being cut to face toward the air flowing direction W are formed between each adjacent pair of tubes 101. The clearance holding portions 105 are respectively formed at a front edge side (an upstream side of the air flowing direction W), a rear edge side, and center positions of the plate fin 100 in the air flowing direction.

As shown in FIG. 5, the front line tubes 101 and the rear line tubes 101 are alternately formed with the louvers 103 in a longitudinal direction of the plate fin 100. Further, as shown in FIG. 6, each of the tubes has circular cross-section.

However, in the conventional plate-fin type heat exchanger shown in FIGS. 4 through 6, the clearance holding portions 105 are formed at the upstream side of the louvers 103 in the air flowing direction, and therefore, air flow is disturbed by the clearance holding portion 105 before air flows into the louvers 103. The louvers 103 are used for distributing air boundary layer caused when air passing through the clearances of the plate fins and for increasing the heat exchange efficiency. When the air flow is disturbed by the clearance holding portion 105 before air flows into the louvers 103, the louvers 103 cannot obtain sufficient effects. Further, because the clearance holding portions 105 are formed at upstream and downstream sides of the louvers 103 in the air flowing direction W, the louvers 103 cannot extend to edge portions of the plate fins 100. Thus, it is difficult to increase the number of louvers 103 for improving the heat exchange efficiency.

SUMMARY OF THE INVENTION

In view of the foregoing problems, it is an object of the present invention to provide a plate-fin type heat exchanger which solves the above-described problems in which the louvers cannot obtain sufficient effects and an area where the louvers are formed is restricted.

According to present invention, a holding portion for holding a clearance between each pair of adjacent plate fins, is spaced from a side edge of a louver in the plate fin by a predetermined distance in a direction perpendicular to a flowing direction of first fluid to be disposed between a pair of adjacent tubes. Thus, air flowing between the plate fins flows through the louvers without being disturbed by the holding portions, and an effect of the louvers for improving the heat-exchanging performance can be maintained sufficiently. Further, an area where the louvers are formed can be increased, and therefore, an efficiency of the entire heat exchanger can be improved.

Preferably, the holding portion is disposed in a line passing through a center of the tube along the flowing direction of the first fluid.

The holding portion may be disposed at an upstream side or a downstream side of the tubes in the flowing direction of the first fluid.

More preferably, the plate fins and the tubes are made of aluminum alloy, and the tubes and plate fins are connected to each other by expanding the tubes after the tubes are inserted into holes formed in the plate fins.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention are described hereinafter with reference to the accompanying drawings.

A first embodiment in which the present invention is used for a radiator for a vehicle will be described.

Figure 1:
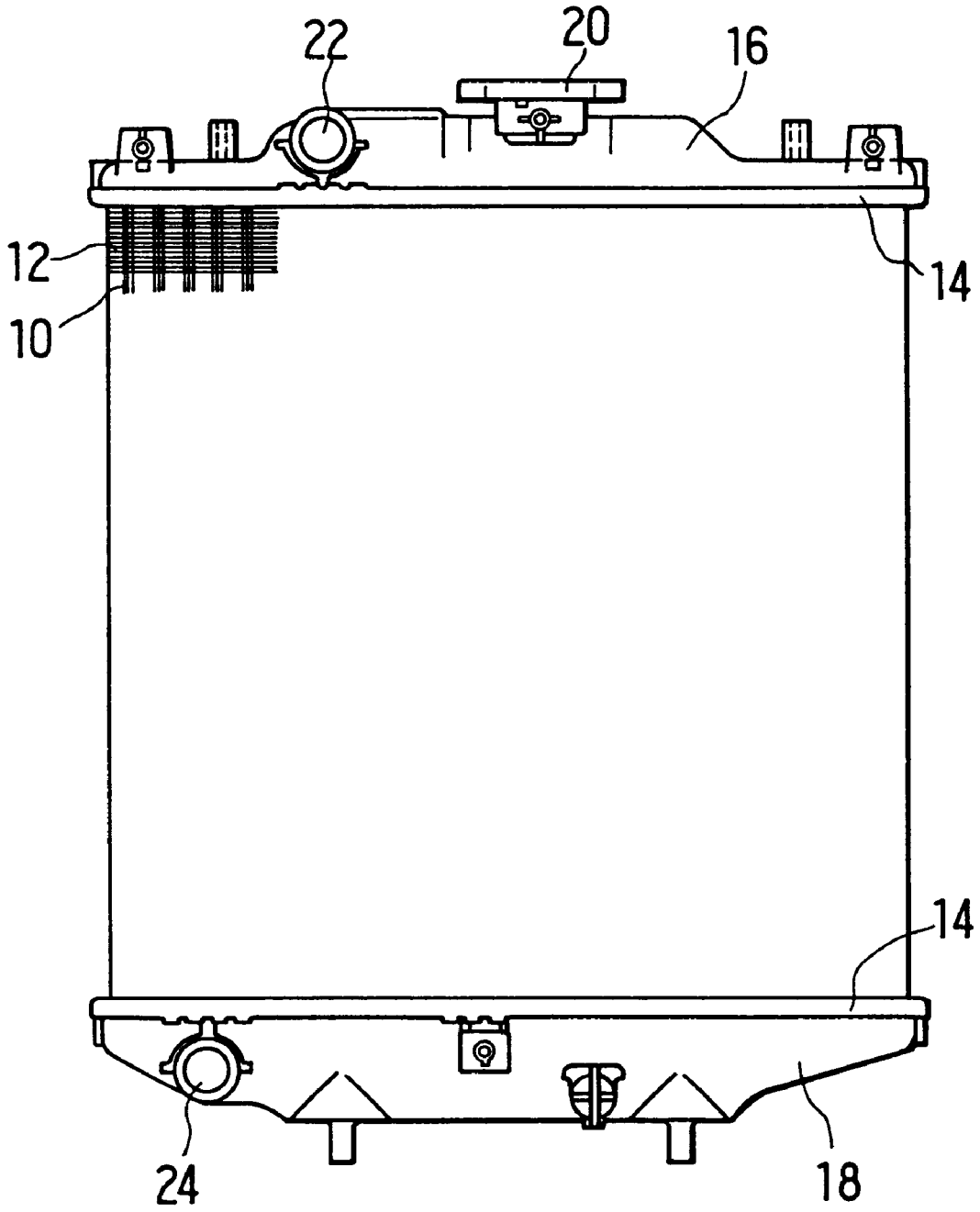
FIG. 1 is a front view showing a radiator for a vehicle according to a first embodiment of the present invention.

FIG. 1 shows a front view showing the radiator for a vehicle. A plurality of tubes 10 made of aluminum alloy are disposed in two parallel lines, and plate fins 12 made of aluminum alloy are connected to outer peripheries of the tubes 10 by expanding the tubes 10 after the tubes 10 are inserted into holes formed in the plate fins 12. Two ends of each tube 10 are connected to two header plates 14, and upper tank 16 and lower tank 18 are respectively fixed to the header plates 14 by a caulking method, for example.

In the upper tank 16, there are formed a cap 20 for receiving cooling water to the radiator, and an inlet 22 for introducing cooling water from engine (not shown) to the radiator.

In the lower tank 18, there is formed an outlet 24 for discharging the cooling water gathered in the lower tank 18 through the tubes 10 to the engine.

Figure 2:
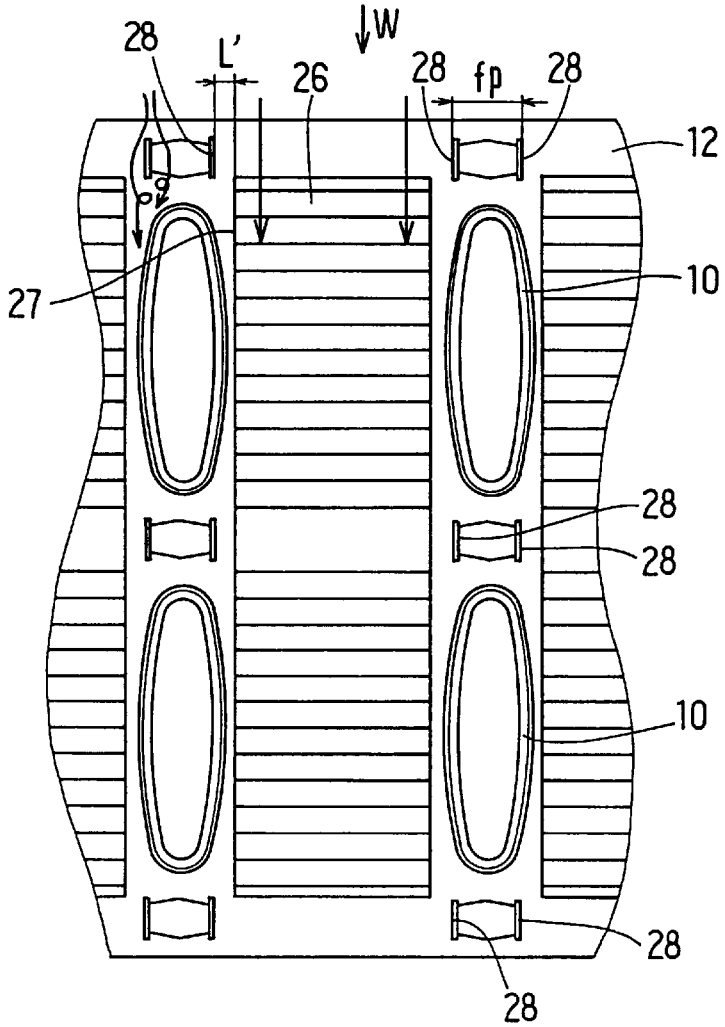
FIG. 2 is a partial plan view showing a plate fin according to the first embodiment.
Figure 3:
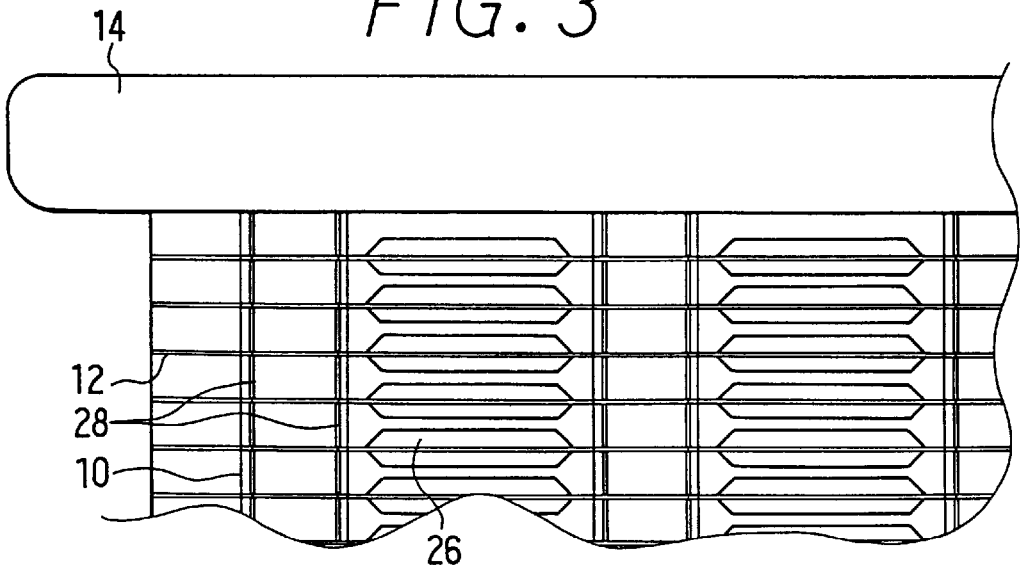
FIG. 3 is a partial front view showing tubes and the plate fins according to the first embodiment.
Figure 4:
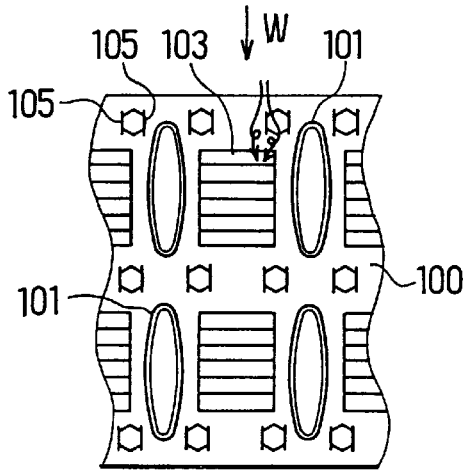
FIG. 4 PRIOR ART
FIG. 4 is a partial plan view showing a conventional plate fin.
Figure 5:
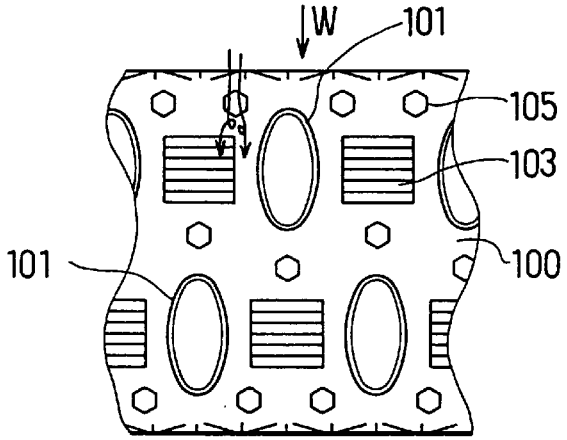
FIG. 5 PRIOR ART
FIG. 5 is a partial plan view showing a conventional plate fin.
Figure 6:
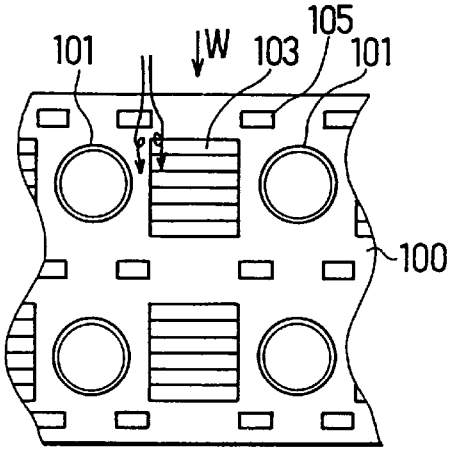
FIG. 6 PRIOR ART
FIG. 6 is a partial plan view showing a conventional plate fin.

As shown in FIGS. 2 and 3, a plurality of plate fins 12 are laminated in a longitudinal direction of the tube 10 while maintaining a predetermined clearance therebetween. Tubes 10 respectively have an elliptical shaped transverse cross-section, and are disposed in two parallel lines perpendicular to an air flowing direction W to form front line tubes 10 (i.e., upstream side tubes in the air flowing direction W) and rear line tubes 10 (i.e., downstream side tubes in the air flowing direction). Between each adjacent pair of the tubes 10 disposed in the same line, louvers 26 for distributing boundary flow caused by the front edge of the plate fin 12 are formed to increase the heat exchange efficiency. The louvers 26 are continuously formed from the front edge side to the rear edge side of the plate fin 12.

The clearance holding portions 28 are respectively formed at upstream sides of the front line tubes 10 in the air flowing direction W, between the front line tubes 10 and the rear line tubes 10 and at downstream sides of the rear line tubes 10 in the air flowing direction W. The plate fin 12 is cut to stand at the left and right directions in FIG. 2 so that the clearance holding portions 28 are formed. As shown in FIG. 3, the clearance holding portions 28 contact with a lower surface of the plate fin 12 disposed just thereabove to maintain a certain clearance between each adjacent pair of the plate fins 12 in the laminating direction. Each height of the clearance holding portions 28 standing from the plate fin 12 is made uniform. Further, as shown in FIG. 2, the holding portions are separated from the louvers to have a predetermined distance L' between the side edge 27 of the louver 26 and the clearance holding portion 28 in the longitudinal direction of the plate fin 12.

Next, an operation of the first embodiment will be described.

Cooling water having a high temperature flows from the engine (not shown) to the upper tank 16 through the inlet 22, and is distributed into each tube 10. The cooling water passing through each tube 10 is cooled by performing heat-exchange with air flowing through between the plate fins 12. The low-temperature cooling water having been heat-exchanged is introduced into the lower tank 18, and returns to the engine from the outlet 24.

The air passing between the plate fins 12 flows in the direction W shown by an arrow in FIG. 2. The air flows through the louvers 26 without being disturbed by the clearance holding portions 28. That is, the air disturbed by the clearance holding portions 28 has no adverse influence against the flow of air passing through the louvers 26.

Further, by the clearance holding portions 28, the air flows around the tubes 10 smoothly, so that the heat exchanger efficiency of the tubes 10 is improved.

Figure 7:
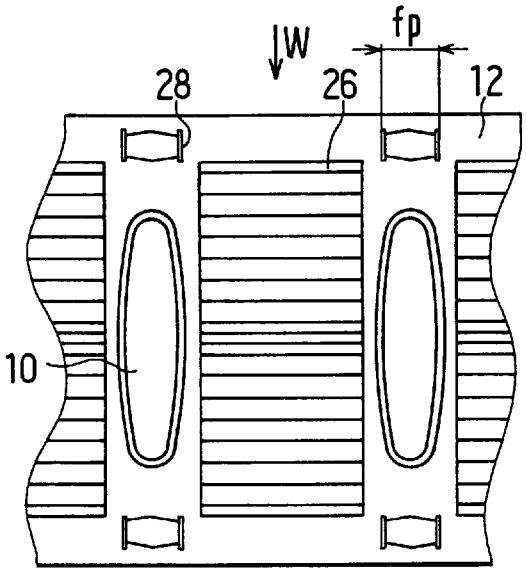
FIG. 7 is a partial plan view showing a plate fin according to a second embodiment of the present invention.

FIG. 7 shows a plate fin 12 according to a second embodiment of the present invention.

In the first embodiment, the tubes 10 are disposed in two parallel lines. However, in the second embodiment, the tubes 10 are disposed in one straight line perpendicular to the air flowing direction W, and the clearance holding portions 28 are disposed at an upstream side and a downstream side of the tubes 10 in the air flowing direction W. The other structures are similar to those of the first embodiment.

Figure 8:
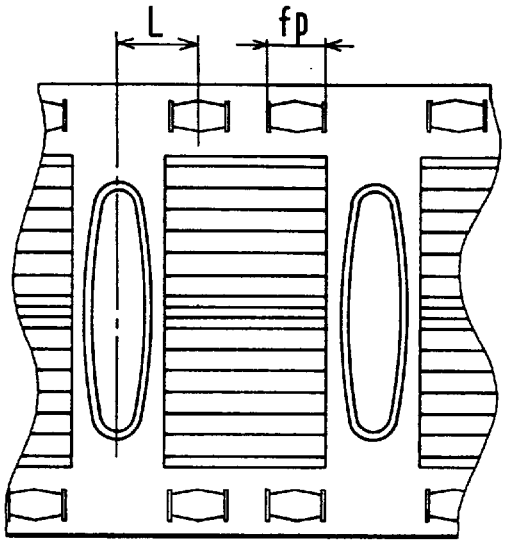
FIG. 8 PRIOR ART
FIG. 8 is a partial plan view showing a conventional plate fin.
Figure 9:
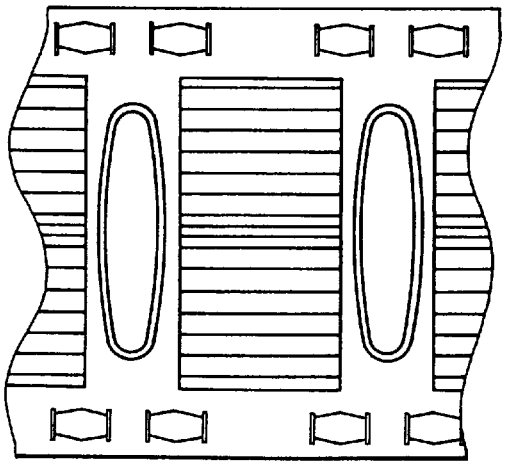
FIG. 9 PRIOR ART
FIG. 9 is a partial plan view showing a conventional plate fin.
Figure 10:
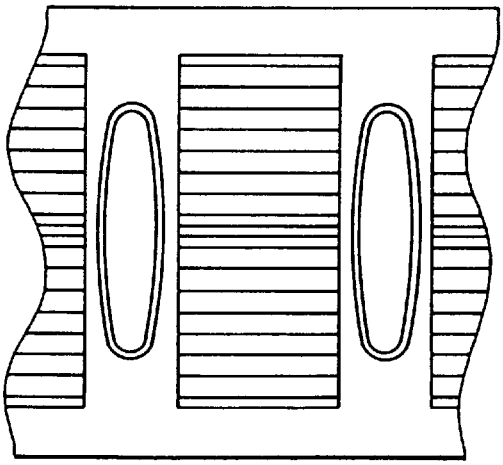
FIG. 10 is a partial plan view showing a plate fin without a clearance holding portion.
Figure 11:
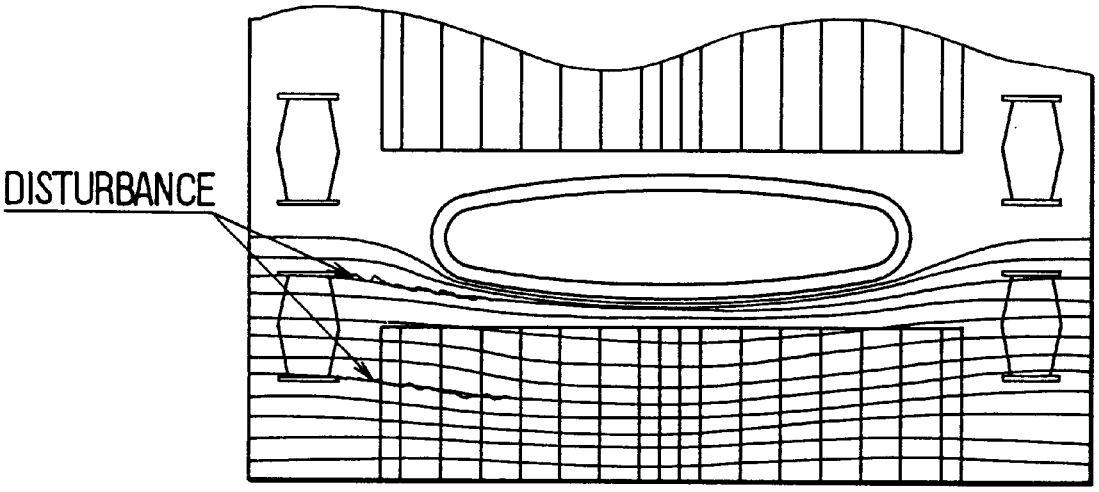
FIG. 11 PRIOR ART
FIG. 11 is a diagrammatic view showing a result of a visualization experiment of air flow when the plate fin shown in FIG. 9 is used.
Figure 12:
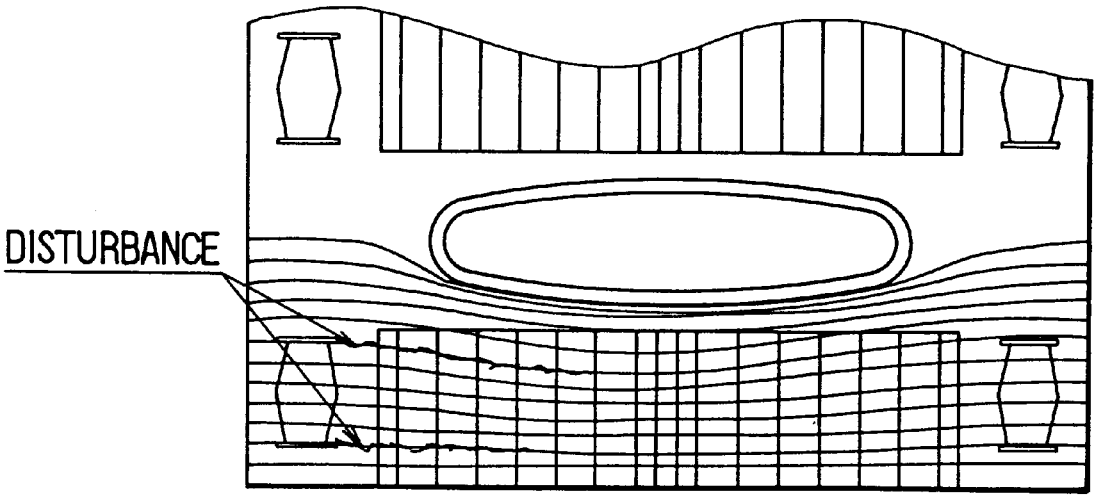
FIG. 12 PRIOR ART
FIG. 12 is a diagrammatic view showing a result of a visualization experiment of air flow when the plate fin shown in FIG. 8 is used.
Figure 13:
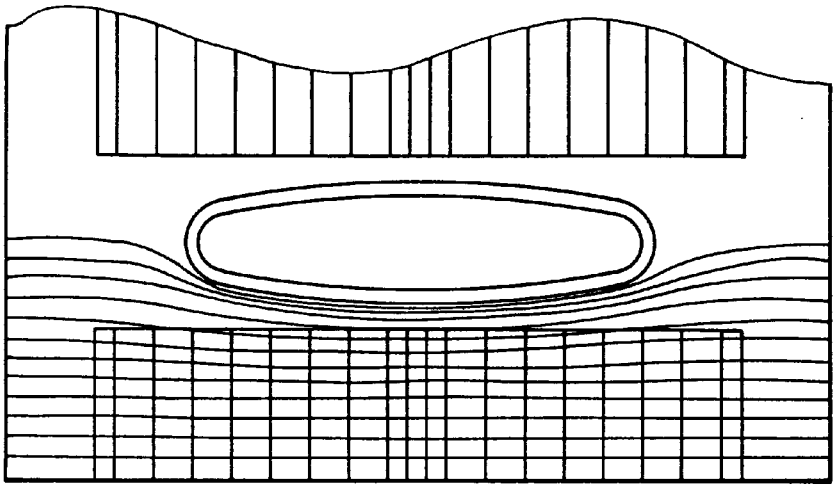
FIG. 13 is a diagrammatic view showing a result of a visualization experiment of air flow when the plate fin shown in FIG. 10 is used.
Figure 14:
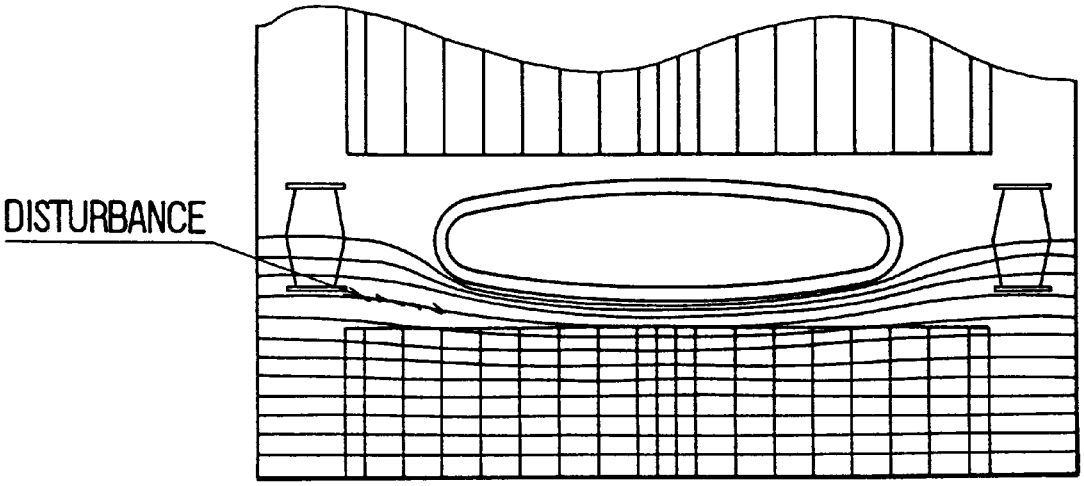
FIG. 14 is a diagrammatic view showing a result of a visualization experiment of air flow when the plate fin of the second embodiment is used.

To confirm the effect of the present invention, the inventors experimentally produced conventional type plate fins shown in FIGS. 8 and 9 and a plate fin without the clearance holding portion shown in FIG. 10, and performed visualization experiments of air flow when each of the plate fins shown in FIGS. 8 through 10 and the plate fin of the second embodiment is employed. The experimental results are shown in FIGS. 11 through 14, respectively. In the conventional type plate fins shown in FIGS. 8 and 9, the air flow is disturbed and meanders greatly at a downstream side of the clearance holding portions 28 as compared with the air flow shown in FIG. 13 in the plate fin without the clearance holding portion 28, so that the effect of the louvers 26 deteriorates. As shown in FIG. 14, in the plate fin 12 of the second embodiment, the air flow disturbance caused by the clearance holding portions 28 gives no adverse influence on the louvers 26, and air flowing through the louvers 26 does not meander, so that an effect similar to that of the plate fin without the clearance holding portion 28 can be obtained. Thus, according to the second embodiment of the present invention, the flow of air passing through the louvers 26 is made uniform, and the effect of the louvers 26 can be maintained sufficiently.

Figure 15:
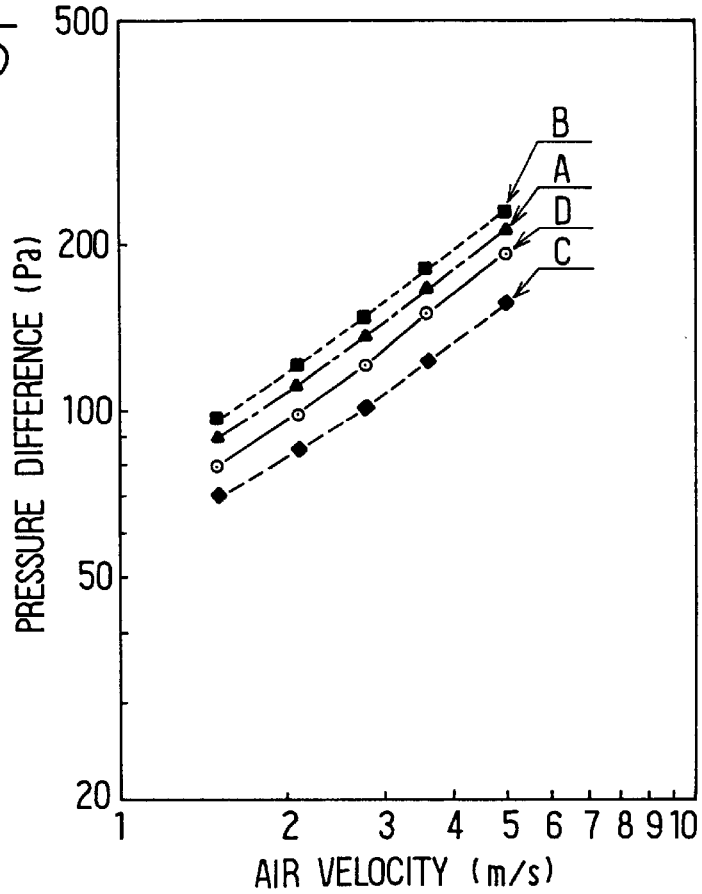
FIG. 15 is a graph showing the relationship between an air velocity and a pressure drop between a front side and a rear side of each plate fin shown in FIGS. 7 through 10.
Figure 16:
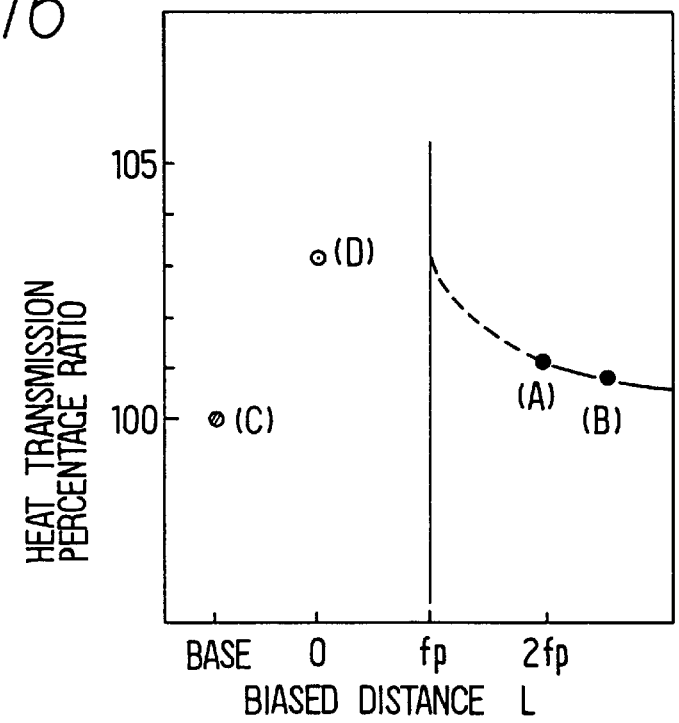
FIG. 16 is a graph showing the relationship between a biased distance L of a clearance holding portion and a heat transfer coefficient ratio (%) of each plate fin shown in FIGS. 7 through 10.
Figure 17:
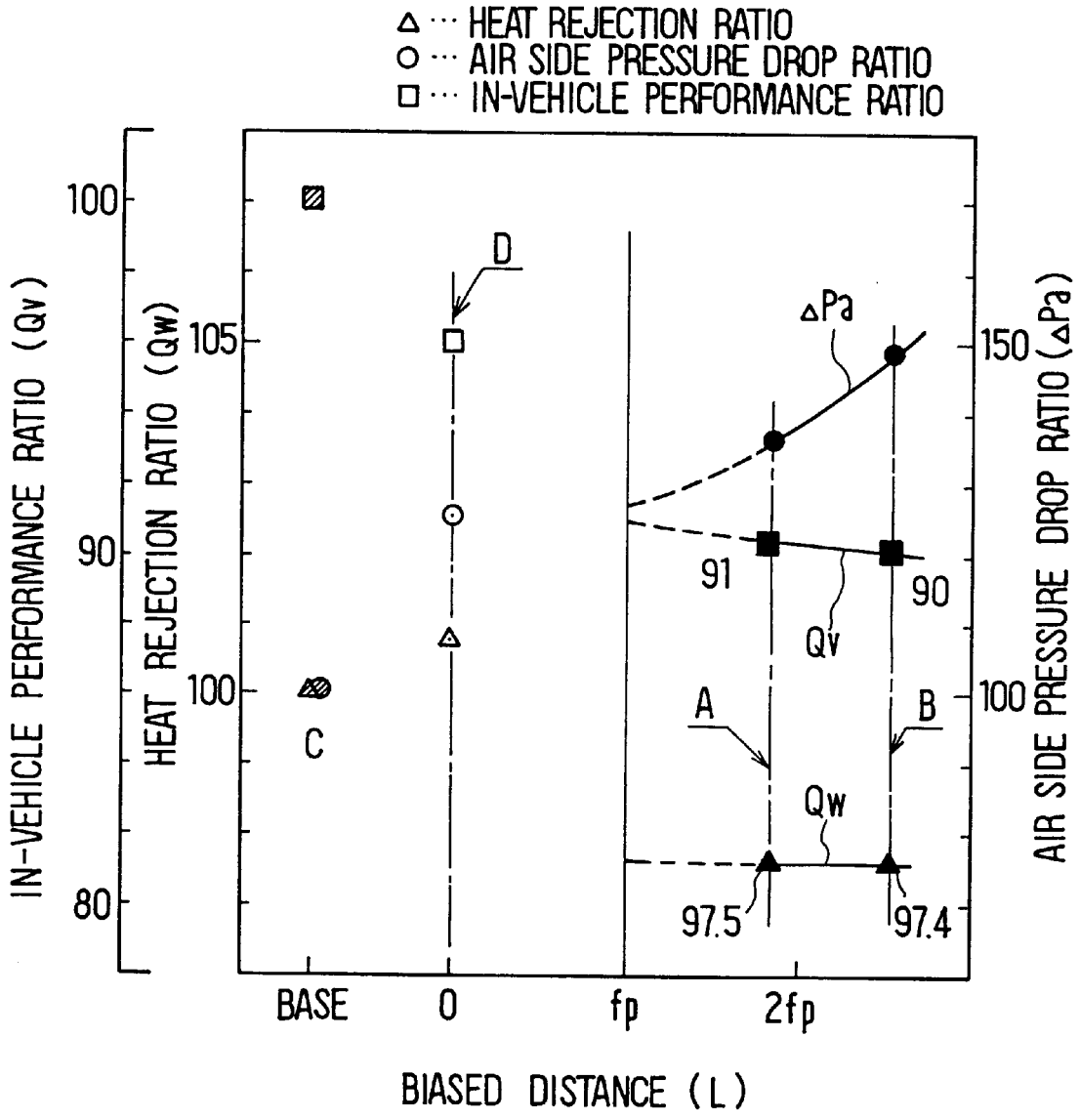
FIG. 17 is a graph showing the relationship between the biased distance L of the clearance holding portion, an air side pressure drop ratio ΔPa, a heat rejection ratio Qw and an in-vehicle performance ratio Qv of each plate fin shown in FIGS. 7 through 10.
Figure 18:
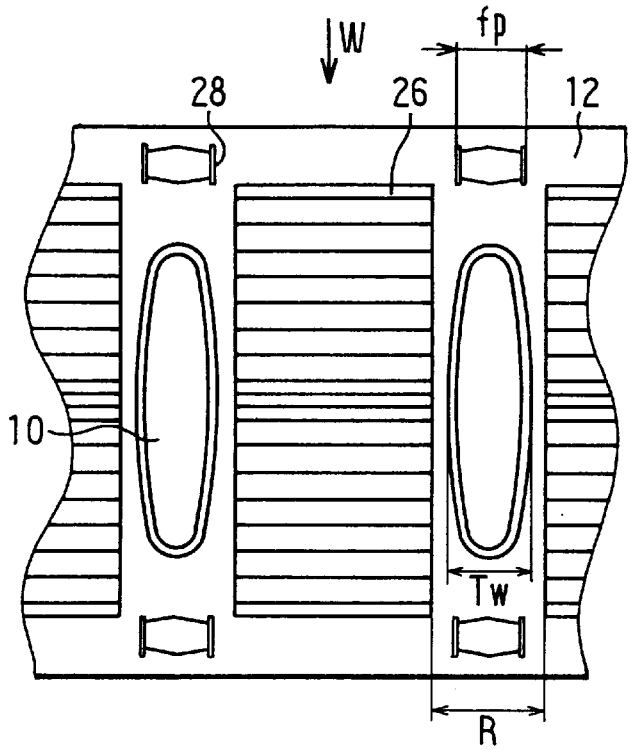
FIG. 18 is a partial plan view of a plate fin, for explaining the relationship between a width (fp) of a clearance holding portion, a width (Tw) of a tube and a distance between adjacent louvers in a longitudinal direction of a plate fin, according to a third embodiment.

Further, the other effects of the present invention will be described with reference to FIGS. 15 through 17. In FIGS. 15 through 17, (A) shows the plate fin shown in FIG. 8, (B) shows the plate fin in FIG. 9, (C) shows the plate fin in FIG. 10, and (D) shows the plate fin of the second embodiment of the present invention.

FIG. 15 shows the pressure drop between the front side and rear side of the plate fin 12 in the air flowing direction W. As shown in FIG. 15, the plate fin 12 of the second embodiment of the present invention has a lower pressure drop as compared with the conventional plate fins shown in FIGS. 8 and 9. When the pressure drop is increased, the disturbance and the meander of the air flow are readily caused.

Further, by the clearance holding portions 28, the flow of air is contracted and smoothed at the front side of the tubes 10 to increase the heat transmitting percentages on the surfaces of the tubes 10. To confirm the effect of the clearance holding portions 28, the inventors performed a comparative experiment shown in FIG. 16. The length of each louvers 28 in the longitudinal direction of the plate fin 12 is indicated as fp, and a biased distance in the longitudinal direction of the plate fin 12 between a center of the clearance holding portion 28 and a center of tube 10 adjacent to the clearance holding portion is indicated as L, as shown in FIGS. 7 and 8. In the first and second embodiments of the present invention, the biased distance L is zero. In FIG. 16, the plate fin without the clearance holding portion is standardized as a base, that is, the heat transfer coefficient ratio of the tube surface is set for 100% in the plate fin without the clearance holding portion 28. As shown in FIG. 16, the heat transfer coefficient ratio of the surfaces of the tubes 10 of the plate fin 12 of the second embodiment are larger than the conventional plate fins 100 shown in FIGS. 8 and 9.

Further, as shown in FIG. 17, the plate fin without the clearance holding portion is standardized as a base, and comparative experiments between the plate fin of the second embodiment and the conventional plate fins shown in FIGS. 8 and 9 are performed. As a result, according to the second embodiment, an air side pressure drop ratio is decreased, a heat rejection ratio (i.e., heat radiation amount ratio, heat transfer rate) is increased, and an in-vehicle performance ratio is increased, as compared with the conventional plate fins shown in FIGS. 8 and 9.

Figure 19:
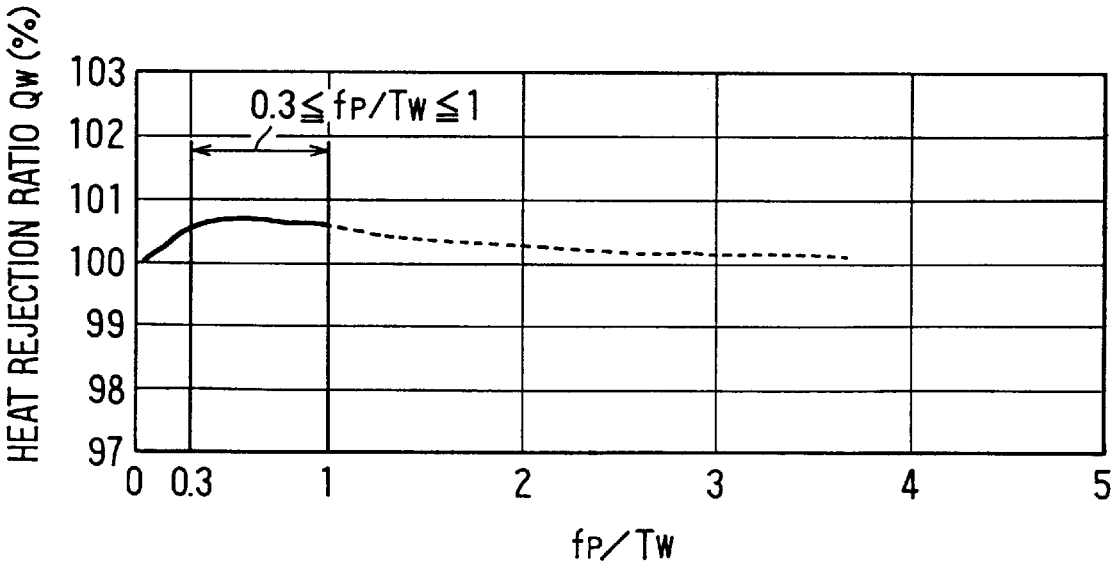
FIG. 19 is a graph showing the relationship between a heat rejection ratio and a ratio (fp/Tw) according to the third embodiment.

A third embodiment of the present invention will be now described. In the third embodiment, a width (fp) of each clearance holding portion 28, a width (Tw) of each tube 10 and a distance (R) between adjacent louvers 26 in the longitudinal direction of the plate fin 12 are set to have the following relationship of $0.3\times Tw \leqq fp \leqq R$. When the width (fp) of each clearance holding portion 28 is in the range between 0.3Tw and the distance R, heat exchanging effect of the heat exchanger can be improved. FIG. 19 is a graph showing the relationship between a heat rejection ratio (i.e., heat radiation amount ratio, heat transfer rate) and a ratio (fp/Tw). In the experiment shown in FIG. 19, a heat rejection of a comparison heat exchanger in which no clearance holding portion 28 is provided is set at 100%, and the heat rejection ratio of the heat exchanger of the present invention relative to the comparison heat exchanger is obtained. Further, the heat rejection ratio in FIG. 19 is obtained in a condition where the width (Tw) of each tube 10 is approximately equal to the distance (R) between the adjacent louvers 26. In the graph of FIG. 19, the solid line is an experimental result by the inventors of the present invention, and the chain line is a calculated result in theory. When the ratio of fp/Tw is smaller than 0.3 (i.e.,fp/Tw<0.3), contraction effect of the flow of air around the tube 10, due to the width (fp) of the clearance holding portion 28, is decreased; and therefore, the flow rate of air around the tube 10 is decreased. Thus, when the ratio of fp/Tw is smaller than 0.3 (i.e.,fp/Tw<0.3), the heat rejection ratio is decreased, as shown in FIG. 19. On the other hand, when the ratio of fp/Tw is larger than 1 (i.e.,fp>Tw), the clearance holding portion 28 is disposed at a direct upstream air side of the louvers 26. That is, the clearance holding portion 28 is overlapped with the louvers 26 in the air flow direction. Therefore, the flow of air passing through the louvers 26 is disturbed by the clearance holding portion 28, the disturbed air passes through the louvers 26, and the flow resistance of air around the tube 10 is further increased. Thus, in this case, heat-exchange performance of the heat exchanger is decreased, and the heat rejection ratio is also decreased. In the third embodiment, because the width (fp) of each clearance holding portion 28 is set in the range of $0.3\times Tw-R$, the clearance holding portions 28 regulate the flow of air passing through around each of the tubes 10 without disturbing the flow of air. Thus, when the width (fp) of each clearance holding portion 28 is set in the range of $0.3\times Tw-R$, the heat rejection ratio is increased.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A plate-fin type heat exchanger for heat-exchanging between a first fluid and a second fluid, said heat exchanger comprising:

a plurality of plate fins laminated from each other to have a predetermined clearance between adjacent plate fins, said first fluid passing through said clearance;

a first holding portion being formed between adjacent plate fins, for holding said clearance, said first holding portion including a pair of first protrusion plates which are disposed in parallel with a flowing direction of said first fluid; and a plurality of tubes in which said second fluid flows, said tubes penetrating through said plate fins in a laminating direction of said plate fins and being arranged in parallel to be perpendicular to the flowing direction of said first fluid, wherein:

each of said plate fins has a plurality of louvers provided between adjacent tubes penetrating said plate fin, said louvers being cut to protrude from an upstream edge side toward a downstream edge side of said plate fin to face the flowing direction of said first fluid;

each of said tubes has an elliptical section on each plate fin, and a longer diameter of the elliptical-shaped section in the flowing direction of said first fluid;

said first holding portion has a width (fp) between said first protrusion plates, in a width direction perpendicular to both of the flowing direction of said first fluid and a flowing direction of second fluid in said tubes;

each of said tubes has a small diameter (Tw) of the elliptical-shaped section in the width direction;

each of said tubes is disposed between adjacent louvers having a predetermined distance (R) therebetween in the width direction; and the width (fp) of the first holding portion is in a range of $0.3\times Tw-R$.

2. A plate-fin type heat exchanger according to claim 1, wherein a ratio (fp/Tw) of the width (fp) of the first holding portion to the small diameter (Tw) of the tubes is in a range of 0.3–1.

3. A plate-fin type heat exchanger according to claim 1, wherein said first holding portion is spaced from a side edge of said louver by a predetermined space in the width direction, and is disposed on an extending line of the longer diameter of the elliptical-shaped section of said tube at an upstream side of said tube in the flowing direction of said first fluid.

4. A plate-fin type heat exchanger according to claim 1, said tubes and said fins are connected to each other by expanding said tubes after said tubes are inserted into holes formed in said plate fins.

5. A plate-fin type heat exchanger according to claim 1, wherein said tubes are disposed in two parallel lines perpendicular to the flowing direction of said first fluid.

6. A plate-fin type heat exchanger according to claim 1, wherein said plate fins and said tubes are made of aluminum alloy.

7. A plate-fin type heat exchanger according to claim 1, wherein each of said first protrusion plates is formed by cutting each plate fin and bending a portion of said plate fin to protrude from each plate fin.

8. A plate-fin type heat exchanger according to claim 1, further comprising p1 a second holding portion being formed between adjacent plate fins for holding said clearance, said second holding portion including a pair of second protrusion plates which are disposed in parallel with the flowing direction of said first fluid, wherein:

said second holding portion has a width (fp) between said second protrusion plates, in the width direction; and the width (fp) of the second holding portion is in a range of 0.3×Tw−R.

9. A plate-fin type heat exchanger according to claim 8, wherein a ratio (fp/Tw) of the width (fp) of the second holding portion to the small diameter (Tw) of the tubes is in a range of 0.3−1.

10. A plate-fin type heat exchanger according to claim 8, wherein said second holding portion is spaced from a side edge of said louver by a predetermined space in the width direction, and is disposed on an extending line of the longer diameter of the elliptical-shaped section of said tube at a downstream side of said tube in the flowing direction of said first fluid.

11. A plate-fin type heat exchanger according to claim 8, wherein each of said second protrusion plates is formed by cutting each plate fin and bending a portion of said plate fin to protrude from each plate fin.

12. A plate-fin type heat exchanger according to claim 1, wherein:

each of said tubes has a first tube end at the most upstream side and a second tube end at the most downstream side in the flowing direction of said first fluid;

each of said lowers has a first louver end at the most upstream side and a second louver end at the most downstream side in the flowing direction of said first fluid; and said first louver end is placed at an upstream side of said first tube end in the flowing direction of said first fluid.

13. A plate-fin type heat exchanger according to claim 12, wherein said second louver end is placed at a downstream side of said second tube end in the flowing direction of said first fluid.

* * * * *